United States Patent [19]

Furuya et al.

[11] Patent Number: 4,793,902

[45] Date of Patent: Dec. 27, 1988

[54] METHOD FOR ELECTROLYZING ZINC AND APPARATUS THEREFOR

[75] Inventors: Nagakazu Furuya, No. 4-3-31, Ohte 2-chome; Satoshi Motoo, No. 5-24, Takeda 3-chome, both of Kofu-shi Yamanashi, Japan

[73] Assignees: Nagakazu Furuya; Satoshi Motoo; Tanaka Kikinzoku Kogyo, all of Japan

[21] Appl. No.: 164,070

[22] Filed: Mar. 4, 1988

[30] Foreign Application Priority Data

Mar. 4, 1987 [JP] Japan ..... 62-49802
Mar. 12, 1987 [JP] Japan ..... 62-57377

[51] Int. Cl.[4] ..... C25D 1/04; C25D 17/00
[52] U.S. Cl. ..... 204/13; 204/216
[58] Field of Search ..... 204/13, 216

[56] References Cited

U.S. PATENT DOCUMENTS 2,944,954 7/1960 Yeck ..... 204/13

*Primary Examiner*—T. M. Tufariello
*Attorney, Agent, or Firm*—Stefan J. Klauber

[57] ABSTRACT

The present invention is a method and an apparatus for electrolyzing zinc.

The method comprises vertically disposing a rotatable disk made of an electrically conductive metal functioning as a cathode at least of which an outer periphery has an insulation covering; immersing the lower portion of the disk into an electrolyte; disposing a circular arc shaped gas permeable electrode functioning as an anode to be closely opposed to the lower portion of the expressed portion of the both sides of the rotatable disk in the electrolyte; operating the electrolysis with the supply of hydrogen; and peeling off the zinc foil deposited onto the exposed portion of the both sides of the rotatable disk with rotation of the disk. This method can be modified by replacing the rotatable disk with a rotatable drum.

The apparatus comprises a rotatable disk cathode made of an electrically conductive metal at least of which an outer periphery has an insulation covering and which is supported vertically and rotatably at the center of the electrolytic cell; a circular arc shaped gas permeable electrode functioning as an anode, and closely opposed to the lower portion of the both sides of the cathode, and fixed to the walls of the electrolytic cell; an electrolyte circulation path located at the desired portion of the anode; and a supply port and a discharge port for hydrogen located at the desired portion of the anodes. This apparatus can be modified by replacing the rotatable disk with a rotatable drum.

6 Claims, 2 Drawing Sheets

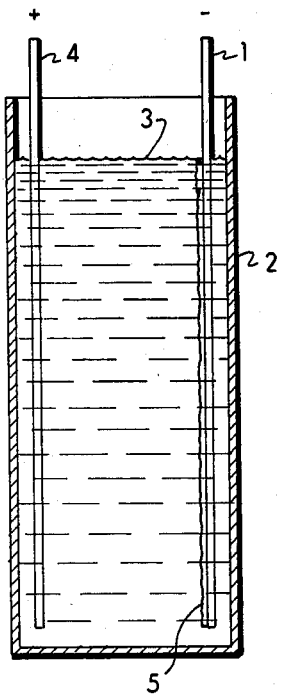
FIG. 1
FIG. 2
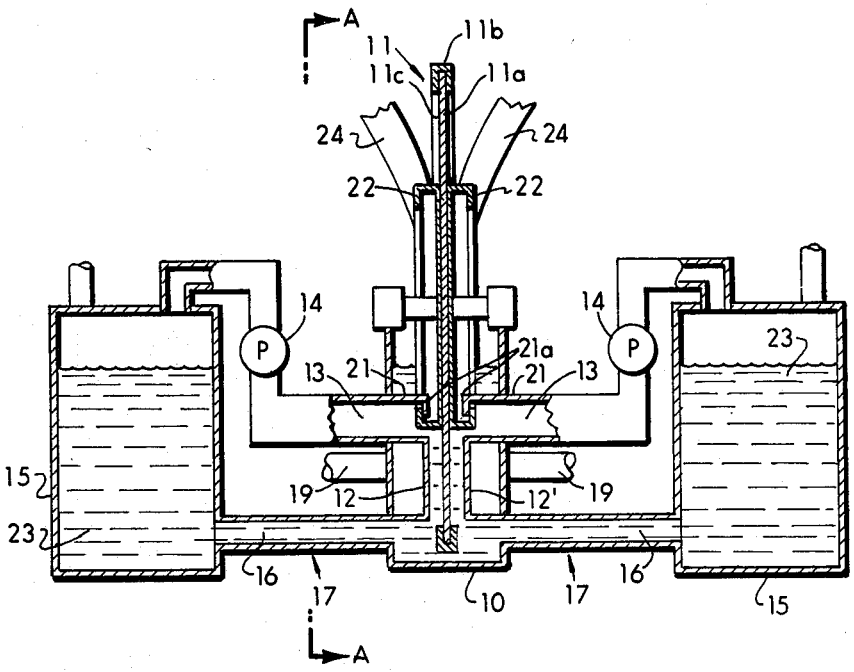
FIG. 3
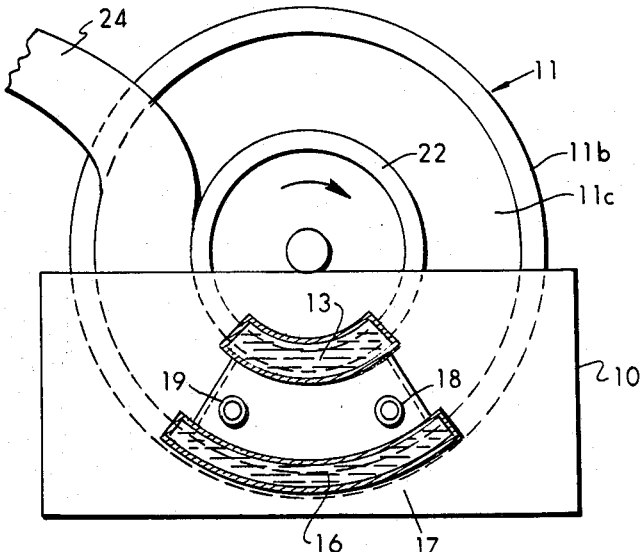

METHOD FOR ELECTROLYZING ZINC AND APPARATUS THEREFOR

BACKGROUND OF THE INVENTION

The present invention relates to a method and an apparatus for electrolyzing zinc.

In a conventional method for electrolying zinc, electrolysis is carried out in such an electrolytic cell 2 as shown in FIG. 1 to deposit the zinc into an Al plate 1. The cell 2 consists of the Al plate 1 functioning as a cathode which is vertically disposed and immersed in electrolyte 3, and a Pb-Ag (1 weight %) plate 4 functioning as an anode which is vertically disposed and immersed in the electrolyte 3 so as to be opposed to the al plate 1.

In the above method for electrolyzing zinc, however, the oxygen overvoltage of oxygen evolved on the Pb-Ag plate 4 is high, and the electric current is difficult to flow due to the oxygen bubbles. Therefore, the rate of the electrolysis is so slow that it requires a long time to electrolytically deposit the zinc 5 onto the Al plate 1. Further, since the peel-off of the zinc 5 from the Al plate 1 is required every 40 hours or more, the efficiency is quite poor. Since, moreover, the Al plate 1 must be pulled up from the electrolyte 3 on all such occasions, the working efficiency is quite poor.

When, in order to overcome these disadvantages, the voltage is elevated to accelerate the electrolysis rate, the cell voltage rises due to the electrolyte resistance, and further the temperature of the electrolyte 3 rises to require large power consumption to that extent. When the resistance between the electrodes is lowered by making the inter-electrode distance smaller, the volume of the oxygen bubbles in the electrolyte 3 evolved on the Pb-Ag plate 4 remarkably increases because the oxygen bubbles are difficult to pass through so that the electric current is more difficult to flow. When, in such conditions, the oxygen evolved on the anode and the hydrogen evolved on the cathode are tried to be separately taken out, it is difficult to accomplish it because the oxygen and the hydrogen are likely to be mixed.

Moreover, in the conventional method for electrolyzing zinc, transition metals are likely to be contained in an electrolytic bath which evolve hydrogen and decrease the current efficiency. Therefore, the zinc electrolysis is generally conducted in the clean bath after dummy electrolysis is performed to eliminate the transition metals. However, this method of electrolysis is insufficient to obtain a satisfactory current efficiency because the hydrogen is likely to evolve when the current density is increased.

SUMMARY OF THE INVENTION

The present invention has been made to provide a method and an apparatus for electrolyzing zinc which overcomes the above problems.

Therefore, one object of this invention is to provide a method and an apparatus for electrolyzing zinc in which substantially no oxygen is produced on an anode so that the flow of the electric current is smooth to increase the electrolysis rate to improve the electrolysis efficiency.

Another object of the invention is to provide a method and an apparatus for electrolyzing zinc in which hydrogen evolved on a cathode is never admixed with the oxygen so that no separation between them is required to improve the working efficiency.

A further object of this invention is to provide a method and an apparatus for electrolyzing zinc in which a zinc foil is continuously obtained without stopping electrolysis.

A still further object of the invention is to provide an apparatus for electrolyzing zinc of which a size can be made smaller.

This invention relates to a method for electrolyzing zinc which comprises vertically disposing a rotatable disk made of an electrically conductive metal functioning as a cathode at least of which an outer periphery has an insulation covering; immersing the lower portion of the disk into an electrolyte; disposing a circular arc shaped gas permeable electrode funcitoning as an anode to be closely opposed to the lower portion of the exposed portion of the both sides of the rotatable disk in the electrolyte; operating the electrolysis with the supply of hydrogen; and peeling off the zinc foil deposited onto the exposed poriton of the both sides of the rotatable disk with rotation of the disk.

Another aspect of this invention is an apparatus for electrolyzing zinc comprising a rotatable disk cathode made of an electrically conductive metal at least of which an outer periphery has an insulation covering and which is supported vertically and rotatably at the center of an electrolytic cell; a circular arc shaped gas permeable electrode functioning as an anode, and disposed and closely opposed to the lower portion of the both sides of the cathode, and fixed to the walls of the electrolytic cell; an electrolyte circulation path located at the desired portion of the anode; and a supply port and a discharge port for hydrogen located at the desired portion of the both anodes.

A further aspect of the invention is a method for electrolyzing zinc in which a rotatable drum is employed in place of the rotatable disk in the former method, the present method being further modified due to the difference between the methods accordingly.

A still further aspect of the invention is an apparatus for electrolyzing zinc in which a rotatable drum is employed in place of the rotatable disk in the former apparatus, the present apparatus being further modified due to the difference between the apparatuses accordingly.

DETAILED DESCRIPTION OF THE INVENTION

Since, in the method for electrolyzing zinc according to the present invention, hydrogen depolarizing gas permeable electrode is employed, no oxygen bubbles are formed on its surface and no oxygen bubbles rise to the surface of the electrolyte. Accordingly, the electric current easily passes through and the electrolysis rate becomes high. Since the hydrogen is oxidized on the anode, the voltage can be lowered, the temperature does not rise, and the power comsumption can be reduced to such an extent. Since, moreover, the hydrogen evolved on the cathode is never admixed with the oxygen, the taken-out hydrogen can be reused without further treatment.

Since, in the apparatus for electrolyzing zinc according to the present invention, a cathode is a rotatable disk or drum, and an anode is a gas permeable electrode opposed to the lower or outer portion of the cathode in the electrolyte, on the surface of which no oxygen bubbles are produced so that the inter-electrode distance can be reduced, not only the IR drop due to an electrolyte resistance can be low and the voltage can be lowered but also the resistance between the electrodes can be lowered so that the electric current easily flows and the electrolysis rate can be increased, and further the apparatus can be smaller and the zinc foil is continuously obtained from the cathode.

In one Embodiment of this invention which employs an electrolyte containing one or more total metal ions selected from the group consisting of ions of lead, cadmium, thallium, gallium, indium and mercury, in addition to the zinc and sulfuric acid, the evolution of the hydrogen can be depressed more fully because it is supposed that formation of nuclei for evolving the hydrogen is effectively inhibited when the zinc is electrolytically deposited, so that the current efficiency can be increased about up to 5% compared with that of the prior art. The content of the metal ions is preferably between 100 and 1000 ppm.

As seen from the foregoing and following description, according to the method for electrolyzing zinc of this invention, no oxygen bubbles are formed on the surface of the cathodes so that no oxygen bubbles rise to the surface of the electrolyte. Since, therefore, the electric current flows smoothly and the electrolysis rate is high, the electrolysis efficiency is remarkably elevated. Further, the voltage can be lowered, the temperature of the electrolyte does not rise and the power consumed can be reduced. Moreover, the hydrogen evolved on the cathode is never admixed with oxygen so that the hydrogen can be taken out and supplied to the anodes for reuse without further treatment to elevate the electrolysis efficiency.

Further, since, in the apparatus for electrolyzing zinc according to the invention, the cathode is the rotatable disk or drum, and the anode which are opposed to the lower or outer portion of the cathode in the electrolysis is the gas permeable electrode which produces substantially no oxygen bubbles on its surface, the distance between the electrodes can be reduced considerably up to several mm. Therefore, not only the resistance due to the electrolyte between the electrodes can be lowered and the voltage can be reduced, but also the electric current flows smoothly and the electrolysis rate can be higher, and moreover the apparatus can be made smaller and the zinc foil can be continuously obtained on the both sides or the outer surface of the cathode so that both the productivity and the working efficiency can be elevated.

BRIEF DESCRIPTION OF THE DRAWINGS

FIG. 1 is a front vertical sectional view showing a conventional apparatus for electrolyzing zinc;

FIG. 2 is a front vertical sectional view showing a first Embodiment of an apparatus for electrolyzing zinc according to the present invention;

FIG. 3 is a side elevational view taken in the direction of the arrows A—A of FIG. 2;

DESCRIPTION OF THE PREFERRED EMBODIMENTS

Figure 4:
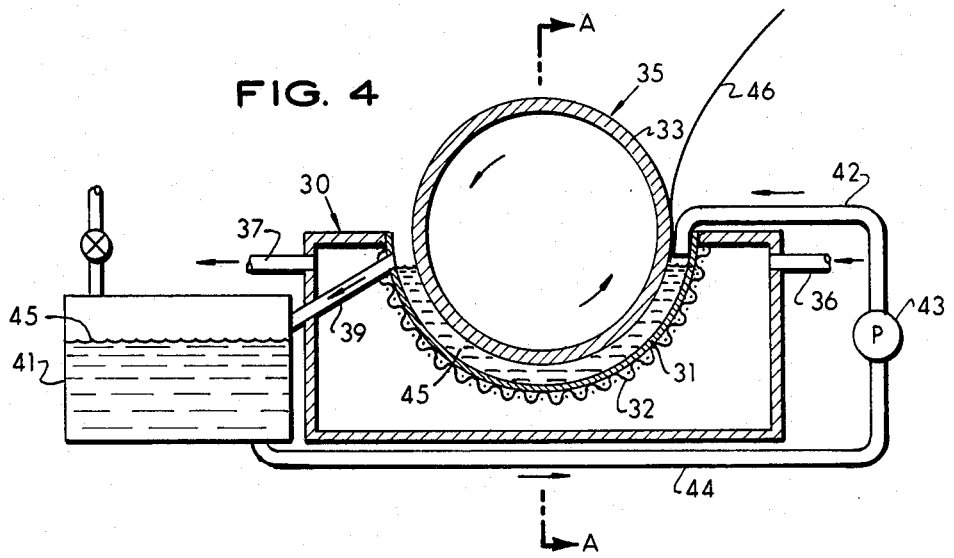
FIG. 4 is a front vertical sectional view showing a second Embodiment of an apparatus for electrolyzing zinc according to the present invention.

The present invention will be illustrated in accordance with the following preferred Embodiments and Examples, but it should be understood that the invention is not limited thereto.

At first, the electrolyzing apparatus of the first Embodiment will be described referring to FIGS. 2 and 3. 10 denotes an electrolytic cell having a length of 20 mm, a width of 250 mm and a depth of 100 mm and 11 denotes a cathode. The cathode 11 comprises a rotatable disk 11*a* made of such an electrically conductive metal as Al having a diameter of 200 mm and a thickness of 2 mm which is rotatably and vertically supported at the center of the electrolytic cell 10, of which the outer periphery and the central portion of the both sides are concentrically covered with vinyl chloride 11*b* for insulation having an outer diameter of 95 mm and an inner diameter of 75 mm. Being closely opposed, that is with a distance of 2.5 mm, to the lower portion of the both sides' circular exposed portion 11*c* of the cathode 11, a pair of anodes 12, 12' which are a circular-shaped gas permeable electrode and have a width of 20 mm, a length of 75 mm and a thickness of 0.5 mm are vertically positioned and fixed to the both walls of the electrolytic cell 10. At the upper portion of the anodes 12, 12' is provided an electrolyte discharge path 13 at a desired place of which are equipped a pair of pumps 14, and the both ends of the discharge path 13 are open to the upper portion of a pair of reservoirs 15. At the lower portion of the anodes 12, 12' is provided an electrolyte supply path 16 of which both ends are connected to the lower portion of the reservoirs 15.

Accordingly, an electrolyte circulating path 17 is formed at the top and bottom of the anodes 12, 12'. At the both ends of the outer sides of the anodes 12, 12' are provided a hydrogen supply port 18 and a hydrogen discharge port 19, the discharge port 19 being connected to the entrance port of a hydrogen supply and circulating apparatus (not shown) and the base end of the supply port 18 being connected to the exit port of the supply and circulating apparatus. 21 denotes circular arc-shaped coverings which cover the entire length of the anodes 12, 12' at the upper side of the open end of the electrolyte discharge path 13, and the cathode sides of the covering 21 are bent downwards and rectangularly. On the outer periphery of the insulation coverings at the center of the both sides of the cathode 11, is provided a guide ring 22 of which cross section is L-shaped so as to embrace the bent portions 21*a* of the cathode 11 sides of the circular arc shaped coverings 21.

Although, in the above electrolyzing apparatus according to the first Embodiment, the cathode 11 has the rotatable disk 11*a* of Al having the insulation coverings on the outer periphery and on the central portions, the disk 11*a* may have the insulation coverings only on the outer periphery.

Then, the electrolyzing apparatus of the second Embodiment will be described referring to the FIGS. 4 and 5.

The upper surface of an electrolytic cell 30 having a width of 110 mm, a length of 120 mm and a depth of 120 mm is formed by an anode 31 composed of a semicircular gas permeable electrode having a radius of 105 mm, a width of 100 mm and a thickness of 1.0 mm, which is supported to a bottom frame 32 of the electrolytic cell 30 composed of a metal net. Being opposed to the anode 31, a cathode 35 which is composed of a rotating drum 33 made of such an electrically conductive metal as Al having a diameter of 100 mm and a width of 100 mm of which the both ends are covered for insulation with vinyl chloride 34 having a thickness of 1.0 mm in order to expose only the outer surface is rotatably and vertically supported to the both side walls so that a distance between the cathode 35 and the anode 31 is made to be 2.5 mm. At the both ends of the outer ends of the anode 31 are provided a supply port 36 and a discharge port 37 for hydrogen, the discharge port 37 being connected to the entrance port of a hydrogen supply and circulating apparatus (not shown) and the base end of the supply port 36 being connected to the exit port of the hdyrogen supply and circulating appartus. At the one upper end of the electrolytic cell 30 is provided an electrolyte discharge path 39, the front end of which is open to the upper portion of a reservoir 41. At the other end of the electrolytic cell 30 is provided an electrolyte introducing path 42 which is connected to an electrolyte introducing path 44 having a pump 43, the front end of which is connected to the lower portion of the reservoir 41.

Although, in the above electrolyzing apparatus according to the second Embodiment, the electrolyte 45 is circulated through the one discharge path and the one introducing path, the invention is not limited thereto and a plurality of the discharge paths and a plurality of the introducing paths can be equipped to the semicircular anode to promote the circulation of the electrolyte.

Then, the method for electrolyzing zinc employing the apparatus shown in FIGS. 2 and 3 will be described.

A zinc containing solution is supplied as the electrolyte 23 into the electrolytic cell 10 so that a depth of, for example, 70 mm of the outer periphery of the cathode 11 is immersed and the anodes 12, 12' are also immersed. Then, the electrolysis is carried out at an electric current and a voltage of respective pertinent values with the hydrogen being supplied to the anodes 12, 12' from the hydrogen supply and circulating apparatus through the supply port 18 so that the zinc is made to deposit with producing foil onto the circular exposed portion 11c of the both sides of the rotatable disk **11*a*, the zinc foil 24 being peeled off by rotating the cathode 11**.

During the zinc electrolysis, the hydrogen supplied to the anodes 12, 12' is converted into an 11$^+$ ion which then reacts with an $OH^-$ ion to produce water at the surface of the anode 12, 12' in the electrolyte, the excess hydrogen being discharged through the discharge port 19 and again introduced to the entrance port of the hydrogen supply and circulating apparatus and resupplied to the anode 12, 12' with the hydrogen newly supplied from the hydrogen supply and circulating appartus. In this manner, no oxygen bubbles are evolved on the surface of the anode 12, 12' so that no oxygen bubbles rise up to the surface in the electrolyte 23. Therefore, the flow of the electric current is never prevented by the oxygen bubbles, and the electric current flows smoothly so that the electrolysis rate can be made about ten times large than that of the prior art, and moreover the voltage can be reduced to about two-fifth compared to that of the prior art. The current efficiency is about 86~89%. The efficiency can be improved if the recovered hydrogen is included. The temperature of the electrolyte 23 does not rise so that the power consumed can be reduced to such an extent.

Further, the hydrogen evolved on the circular exposed portion 11c of the cathode 11 during the electrolysis and rising to the surface is never diffused into the atmosphere because the upper portion of the electrolyte 23 is covered with the covering 21 so that, by discharging the electrolyte 23 from the upper discharge path 13 of the anode 12, 12' by means of the pumps 14 during the electrolysis and temporarily storing it in the reservoirs 15. The hydrogen rises to the surface and stored in the upper closed space of the reservoir 15 and the electrolyte having been removed of the hhdrogen is introduced into the electrolytic cell 10 from the lower portion of the reservoirs 15 through the supply path 16. Since almost all the hydrogen evolved on the circuit exposed portion **11*c* of the cathode 11 is stored in the upper closed space of the reservoirs 15, the hydrogen can be supplied to the anode 12, 12'** without purification.

Then, the method for electrolyzing zinc employing the apparatus shown in FIGS. 4 and 5 will be described.

A zinc contained solution is supplied as the electrolyte 45 into the electrolytic cell 30 and circulated so that the exposed portion of the lower and the outer surface of the cathode 35 is immersed to a depth of, for example, 90 mm and the surface of the anode is contacted with the electrolyte 45. Then, with hdyrogen being supplied from the hydrogen supply and circulating apparatus to the anode 31 through the supply port 36, the electrolysis is carried out at certain values of an electric current and of a voltage so that zinc is deposited onto the exposed portion of the outer surface of the rotatable drum 33. With formation of the foil, the cathode 35 is rotated to peel off the zinc foil 46.

During the zinc electrolysis, the hydrogen supplied to the anode 31 from the hydrogen supply port 36 is converted into an $H^+$ ion which is then reacts with an $OH^-$ ion to produce water at the surface of the anode 31 in the electrolyte. The excess hydrogen is discharged through the discharge port 37 and again returned to the hydrogen supply and circulating apparatus and supplied to the anode 31 from the hydrogen supply port 36. In this manner, no oxygen bubbles are evolved on the surface of the anode 31 so that no oxygen bubbles rise up to the surface in the electrolyte 45. Therefore, the flow of the electric current is never prevented by the oxygen bubbles, and the electric current flows smoothly so that the electrolysis rate can be made about ten times larger than that of the prior art, and moreover the voltage can be reduced to about two-fifth compared to that of the prior art. The temperature of the electrolyte 45 does not rise so that the power consumed can be reduced to such an extent. Further, the hydrogen evolved on the outer surface of the cathode 35 during the electrolysis and rising to the surface is never diffused into the atmosphere if the upper portion of the electrolyte 45 is covered with a covering so that by discharging the electrolyte 45 from the upper discharge path 39 by means of the pumps 43 during the electrolysis and temporarily storing it in the reservoir 41, the hydrogen rises to the surface and stored in the upper closed space of the reservoir 41 and the electrolyte 45 having been removed of the hydrogen is introduced into the electrolytic cell 30 from the lower portion of the reservoir 41 through the supply paths 44 and 42. Since almost all the hydrogen evolved on the outer surface of the cathode 35 is stored in the upper closed space of the reservoirs 41, the hydrogen can be resupplied to the anode 31. Therefore, the operation efficiency and the current efficiency is improved.

EXAMPLE 1

The electrolysis of zinc was carried out employing the appartus shown in FIGS. 2 and 3. A treated zinc solution (Zn 60 g/Q, $H_2SO_4$ 180 g/Q) was supplied to the electrolytic cell 10 so that a depth of 70 mm of the outer periphery of the cathode 11 and the anode 12, 12' were immersed therin. Then, the electrolysis was conducted at an electric current of 7.5 A and a voltage of 1.5 V with the hydrogen being supplied to the anodes 12, 12' so that the zinc was made to deposit with producing the foil on the exposed portion 11c of the cathode 11. The zinc foil 24 was peeled off by rotating the cathode 11 at the speed of 15 rotation/hr. The current efficiency was 86~89% and the temperature of the electrolyte did not rise during the electrolysis.

EXAMPLE 2

Figure 5:
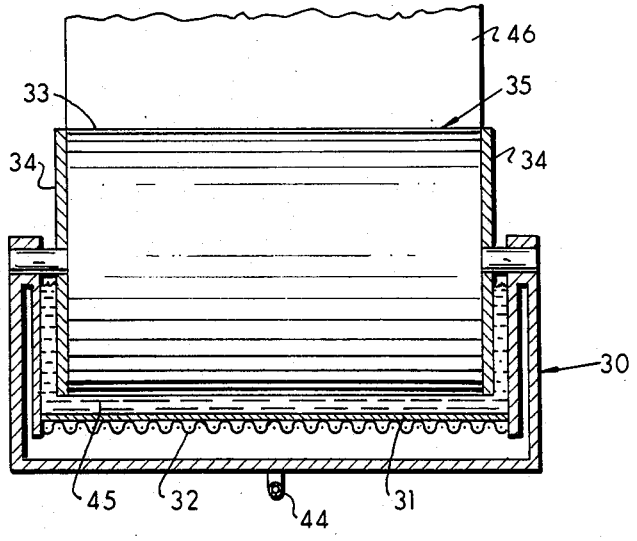
FIG. 5 is a side elevational view taken in the direction of the arrows A—A of FIG. 4.

The electrolysis of zinc was carried out employing the appartus shown in FIGS. 4 and 5. A treated zinc solution (Zn 60 g/Q, $H_2SO_4$ 180 g/Q) was supplied to the electrolytic cell 30 so that a depth of 90 mm of the outer periphery of the cathode 35 was immersed therein, and the anode was contacted with the electrolyte 45. The electrolysis was conducted at an electric current 70 A and a voltage of 1.4 V with the hydrogen being supplied to the anode 31 so that the zinc was made to deposit with producing the foil on the outer surface of the drum 33. The zinc foil 46 was peeled off by rotating the cathode 35 at the speed of 3.0 rotations/hr. The current efficiency was 89% and the temperature of the electrolyte did not rise during the electrolysis.

EXAMPLE 3

The electrolysis of zinc was carried out employing the same conditions and apparatus as Example 1 except that the 500 ppm of a lead ion (sulfate) was contained in the treated zinc solution and an electric current was 8.0 A. The current efficiency was elevated up to 93%.

EXAMPLE 4

The electrolysis of zinc was carried out employing the same conditions and apparatus as Example 1 except that the 500 ppm of a mercury ion (sulfate) was contained in the treated zinc solution and an electric currnet was 75 A. The current efficiency was elevated up to 92%.

While the invention has been described in detail and with reference to the specific Embodiments thereof, it will be apparent to one skilled in the art that various changes and modifications can be made therein without departing from the spirit and scope of the present invention.

What is claimed is:

1. A method for electrolyzing zinc which comprises vertically disposing a rotatable disk made of an electrically conductive metal functioning as a cathode at least of which an outer periphery has an insulation covering; immersing the lower portion of the disk into an electrolyte; disposing a circular arc shaped gas permeable electrode functioning as an anode to be closely opposed to the lower portion of the exposed portion of the both sides of the rotatable disk in the eletrolyte; operating the electrolysis with the supply of hydrogen; and peeling off the zinc foil deposited onto the exposed portion of the both sides of the rotatable disk with rotation of the disk.

2. In a method claimed in claim 1, wherein the electrolyte contains one or more metal ions selected from the group consisting of ions of lead, cadmium, thallium, gallium, indium and mercury, in addition to the zinc and sulfuric acid.

3. A method for electrolyzing zinc, which comprises forming the surface of an electrolytic cell by an anode of a semicircular gas permeable electrode; vertically and rotatably supporting a rotatable drum made of an electrically conductive metal and functioning as a cathode to the walls of the electrolytic cell, the both side surfaces of the drum having an insulation covering; adding an electrolyte to the electrolytic cell so that lower outer surface of the exposed portion of the cathode is immersed with the electrolyte; performing the electrolysis with hydrogen being supplied to the anode; and peeling off zinc foil disposed onto the outer surface of the rotatable drum with rotation of the drum.

4. In a method claimed in claim 3, wherein the electrolyte contains one or more metal ions selected from the group consisting of ions of lead, cadmium, thallium, gallium, indium and mercury, in addition to the zinc and sulfuric acid.

5. An apparatus for electrolyzing zinc comprising a rotatable disk cathode made of an electrically conductive metal at least of which an outer periphery has an insulation covering and which is supported vertically and rotatably at the center of an electrolytic cell; a circular arc shaped gas permeable electrode functioning as an anode, and closely opposed to the lower portion of the both sides of the cathode, and fixed to the walls of the electrolytic cell; an electrolyte circulation path located at the desired portion of the anode; and a supply port and a discharge port for hydrogen located at the desired portion of the anodes.

6. An apparatus for electrolyzing zinc comprising an anode of a semicircular gas permeable electrode forming the bottom of an electrolytic cell; a cathode comprising a rotatable drum made of an electrically conductive metal, and vertically and rotatably and concentrically supported in the electrolytic cell, the outer surface of the cathode having an insulation covering; a supply port and a discharge port at the both ends of the electrolytic cell for supplying hydrogen to the anode; and an electrolyte discharge path equipped in the electrolytic cell.

* * * * *